US005161591A

United States Patent [19]

Sealey et al.

[11] Patent Number: 5,161,591

[45] Date of Patent: Nov. 10, 1992

[54] METHOD AND APPARATUS FOR USE IN PRODUCING RECONSOLIDATED WOOD PRODUCTS

[75] Inventors: Robin D. Sealey, Bayswater; Maxwell G. Campbell, Mount Gambier, both of Australia

[73] Assignee: South Australian Timber Corporation, Australia

[21] Appl. No.: 603,764

[22] PCT Filed: May 17, 1989

[86] PCT No.: PCT/AU89/00215

§ 371 Date: Dec. 31, 1990

§ 102(e) Date: Dec. 31, 1990

[87] PCT Pub. No.: WO89/11383

PCT Pub. Date: Nov. 30, 1989 (Under 37 CFR 1.47)

[30] Foreign Application Priority Data

May 18, 1988 [AU] Australia ..... PI8310

[51] Int. Cl.[5] ..... B27M 1/02

[52] U.S. Cl. ..... 144/362; 144/2 R; 156/256; 156/264

[58] Field of Search ..... 156/256, 264, 266; 144/2 R, 361, 362, 367, 3 R, 367

[56] References Cited

U.S. PATENT DOCUMENTS 3,674,219 7/1972 Harvey, Jr. .

4,672,006 6/1987 McGraw ..... 144/362

4,695,345 9/1987 Grace ..... 144/362

*Primary Examiner*—W. Donald Bray

*Attorney, Agent, or Firm*—Sughrue, Mion, Zinn, Macpeak & Seas

[57] ABSTRACT

Apparatus and method for spreading and refining natural wood (13) which has been crushed in a pair of crushing rollers, to form a flexible open lattice work web (14) of naturally interconnected wood strands which are generally aligned along a common grain direction and a substantial proportion of which are substantially discrete but incompletely separated from each other. The spreading and refining is performed by passing the crushed carcass (14) through at least two roller pairs (30) which have spaced corrugated rollers (32) with the maximum spacing between the corrugations of the opposed spaced corrugated rollers decreasing in the roller pairs with increasing distance from the crushing rollers. At least one roller (32) of each spaced corrugated roller pair is axially reciprocated. Between said at least two spaced corrugated roller pairs (30) is a pair (66) of intermeshing corrugated rollers (70, 74). A pair (46) of rollers (50, 56) incorporating a series of axially spaced blades (48) may be provided to break up knots and spiral grain growth and downstream of a last of the spaced corrugated roller pairs (30) a rolling harrow (82) or further pair (66) of intermeshing rollers may be provided.

19 Claims, 4 Drawing Sheets

FIG. 3a1
Step 1
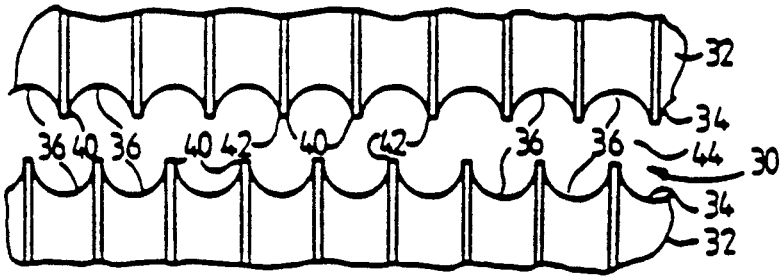
FIG. 3a2
Step 2
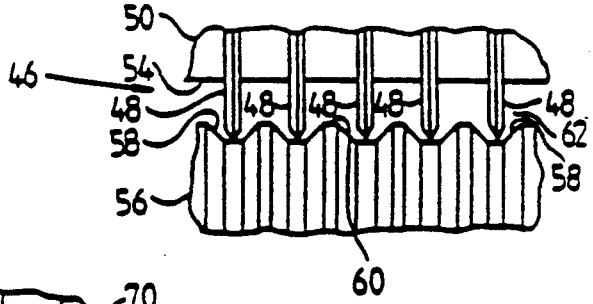
FIG. 3a3
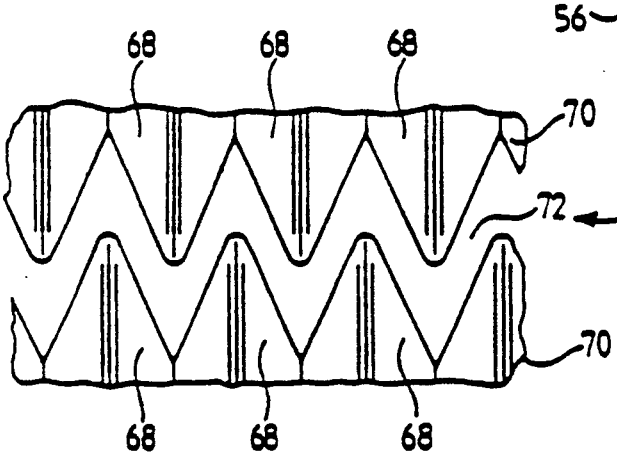
Step 3
FIG. 3a4
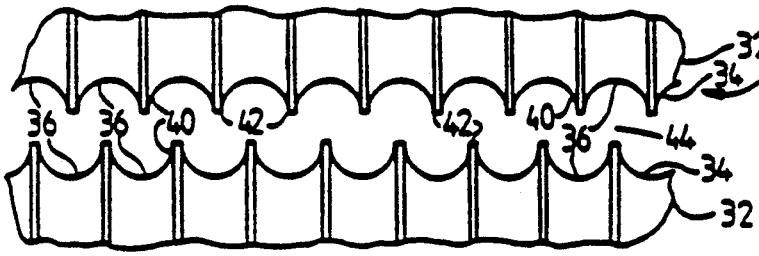
Step 4

FIG. 3b1
Step 5
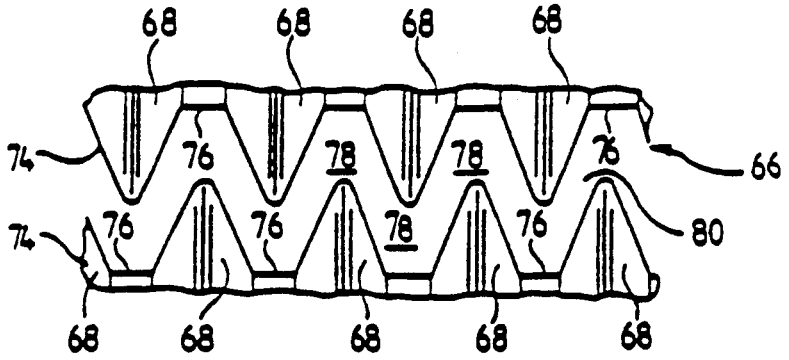
FIG. 3b2
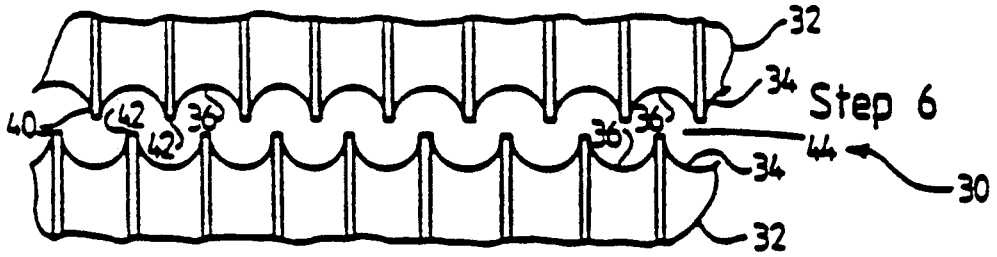
FIG. 3b3
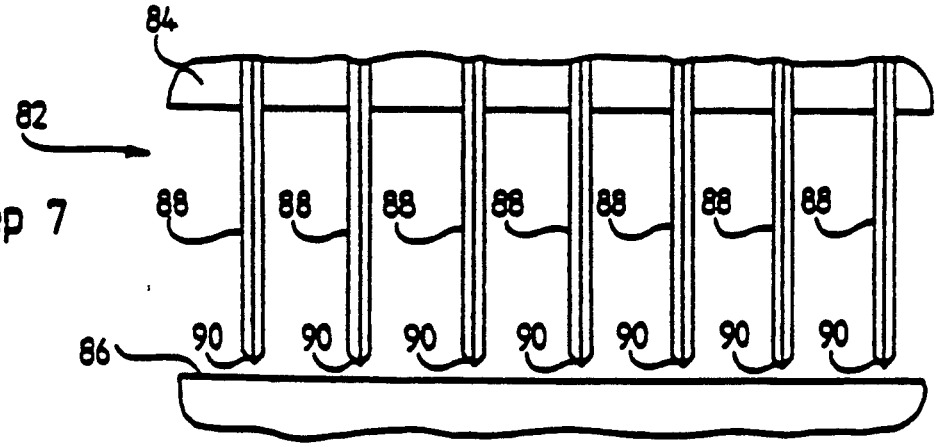

METHOD AND APPARATUS FOR USE IN PRODUCING RECONSOLIDATED WOOD PRODUCTS

This invention relates to an improved method and apparatus for use in producing reconsolidated wood products.

Australian Patent Specification 510,845 describes a reconsolidated wood product formed from at least one flexible open lattice work web of naturally interconnected wood strands generally aligned along a common grain direction, a substantial proportion of said strands being substantially discrete but incompletely separated from each other; said web having been consolidated by compression whilst substantially maintaining the wood strands aligned along said common grain direction and said strands being bonded together to hold them in juxtapositions assumed pursuant to said consolidation.

That patent specification also describes a process for forming a reconsolidated wood product, the process comprising the steps of partially rending natural wood to form a flexible open lattice work web of naturally interconnected wood strands which are generally aligned along a common grain direction, a substantial proportion of said strands being substantially discrete but incompletely separated from each other, compressing the web to consolidate the strands whilst maintaining them such as to substantially extend in said original grain direction and bonding said strands together to hold them in juxtapositions assumed pursuant to said consolidation.

The process described in Australian Patent Specification 510,845 (whose disclosure is incorporated herein by reference) has been found to be generally quite satisfactory. However, the quality of the resultant product is influenced by the quality of the webs used to form the product. In particular, an even web having homogeneously partially separated strands is required for best results. When plane rolling alone is employed to produce the webs, the webs may not always be adequately "teased-out", possibly having portions where individual strands are still relatively tightly bundled together, and other portions where the strands are widely separated. Also, there may be a tendency to break an excessive number of individual strands during rolling, thereby weakening the wood structure unnecessarily.

The invention seeks to provide a process and apparatus which facilitates production of good quality webs and reconsolidated wood products.

The invention provides a process for partially rending natural wood to form a flexible open lattice work web of naturally interconnected wood strands which are generally aligned along a common grain direction, a substantial proportion of said strands being substantially discrete but incompletely separated from each other, said rending being effected by crushing the natural wood between a pair of rollers arranged with generally parallel axes by rollingly engaging the natural wood from either side to form an open carcase of the natural wood and by spreading and refining the carcase to form the web, said spreading and refining comprising passing the crushed carcase through at least two roller pairs which have spaced corrugated rollers and in which the maximum spacing between the corrugations of the opposed spaced corrugated rollers decreases in the roller pairs with increasing distance along a spreading and refining path from the crushing rollers, reciprocating at least one roller of each spaced corrugated roller pair relative to the other roller of said pair during said pass, and passing the carcase through a pair of intermeshing corrugated rollers after said pass through a first of the pairs of spaced corrugated rollers and before said pass through a further of the pairs of spaced corrugated rollers.

The invention also provides apparatus for rending natural wood to form natural wood into a flexible open lattice work web of substantially parallel aligned naturally interconnected strands, the apparatus comprising a pair of spaced generally parallel axially rotatable crushing rollers, at least two roller pairs downstream of the crushing roller pair each comprising a pair of spaced generally parallel axially rotatable corrugated rollers of which at least one is reciprocable relative to the other with the maximum spacing between the corrugations of the opposed spaced rollers decreasing in the roller pairs with increasing distance along a spreading and refining path from the crushing roller pair, means for axially reciprocating said at least one roller relative to the other roller of each spaced corrugated roller pair, and a pair of intermeshing corrugated rollers between said at least two spaced corrugated roller pairs.

By the term "corrugated roller" as used herein is meant a roller whose peripheral surface has a series of annular troughs with adjacent troughs separated by an annular peak, the troughs and peaks being co-axial with the axis of rotation of the roller.

Preferably the reciprocating means is arranged to axially move one of the rollers, the other being substantially fixed axially, but said means may alternatively be arranged to axially move both rollers of the spaced corrugated roller pairs. In any event the apparatus may be arranged such that the rate of said movement may be varied depending on the rotational surface velocity of the rollers, or on the size and quality of the natural wood, or on the extent to which the wood passing between said rollers has been previously reduced to a flexible open lattice work web. Usually, too, at least one of the rollers of the spaced corrugated roller pairs is rotationally driven and both rollers may, if desired, be so driven.

Preferably the trough of each corrugation of the spaced corrugated roller pairs is part circular in cross-section. Most advantageously, the troughs are substantially semi-circular and the troughs in each roller may be closely spaced to define a narrow peak between adjacent roughs. The spacing of the spaced corrugated roller pairs may be reduced by having the rollers of successive downstream spaced corrugated roller pairs along the spreading and refining path closer together.

It has been found that the effect of the process and apparatus of this invention is to produce a more effectively "teased-out" web structure, with less strand breakage. The intermeshing roller pair spreads the web by increasing the path across the width of the web and the separation of the intermeshing rollers will preferably be adjusted according to the spacing of the adjacent downstream spaced corrugated roller pair.

Where more than two pairs of spaced corrugated rollers are provided an intermeshing roller pair is conveniently provided between every two pairs.

Preferably the corrugations of the or each intermeshing roller pair are substantially sinusoidal, optionally with lands between adjacent peaks.

The integrity of the carcase may be additionally reduced during the spreading and refining process by passing the crushed carcase though a pair of rollers in which one is corrugated and the other comprises an axial series of blades each aligned with a respective groove in the corrugated roller.

Further according to the present invention there is provided a process for forming a reconsolidated wood product which comprises the steps of partially rending natural wood to form a plurality of flexible open lattice work webs each of naturally interconnected wood strands which are generally aligned along a common grain direction, a substantial proportion of said strands in each web being substantially discrete but incompletely separated from each other, superposing the webs, compressing the superposed webs to consolidate the strands whilst maintaining them such as to substantially extend in said original grain direction and bonding the strands of the webs together to hold them in juxtapositions assumed pursuant to said consolidation, and wherein said partially rending step is effected by crushing the natural wood between a pair of rollers arranged with generally parallel axes by rollingly engaging the natural wood from either side to form an open carcase of the natural wood and by spreading and refining the carcase to form the web, said spreading and refining comprising passing the crushed carcase through at least two roller pairs which have spaced corrugated rollers and in which the maximum spacing between the corrugations of the opposed spaced corrugated rollers decreases in the roller pairs with increasing distance along a spreading and refining path from the crushing rollers, reciprocating at least one roller of each spaced corrugated roller pair relative to the other roller of said pair during said pass, and passing the carcase through a pair of intermeshing corrugated rollers after said pass through a first of the pairs of spaced corrugated rollers and before said pass through a further of the pairs of spaced corrugated rollers.

Still further according to the present invention there is provided a reconsolidated wood product when formed by the process described in the immediately preceding paragraph.

One embodiment of the process and apparatus in accordance with the present invention is further described by way of example only with reference to the accompanying drawings in which.

Figure 2:
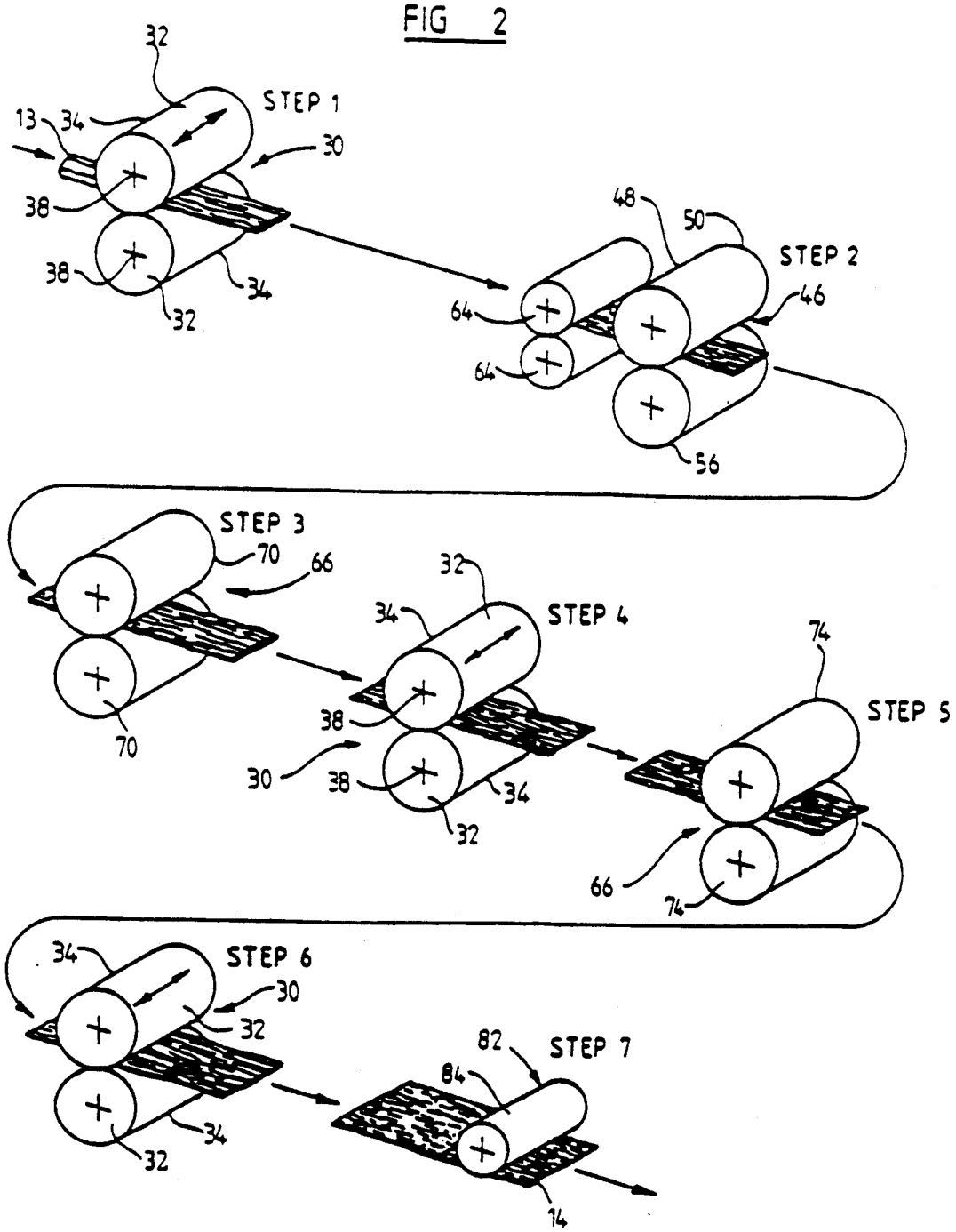
FIG. 2 is a schematic view of spreading and refining apparatus in accordance with the present invention.

FIG. 3*a* illustrates in detail steps 1 to 4 of the apparatus of FIG. 2; and FIG. 3*b* illustrates in detail steps 5 to 7 of the apparatus of FIG. 2.

In FIGS. 3*a* and 3*b* the opposed rollers of the roller pairs have been only partly shown for convenience.

Figure 1:
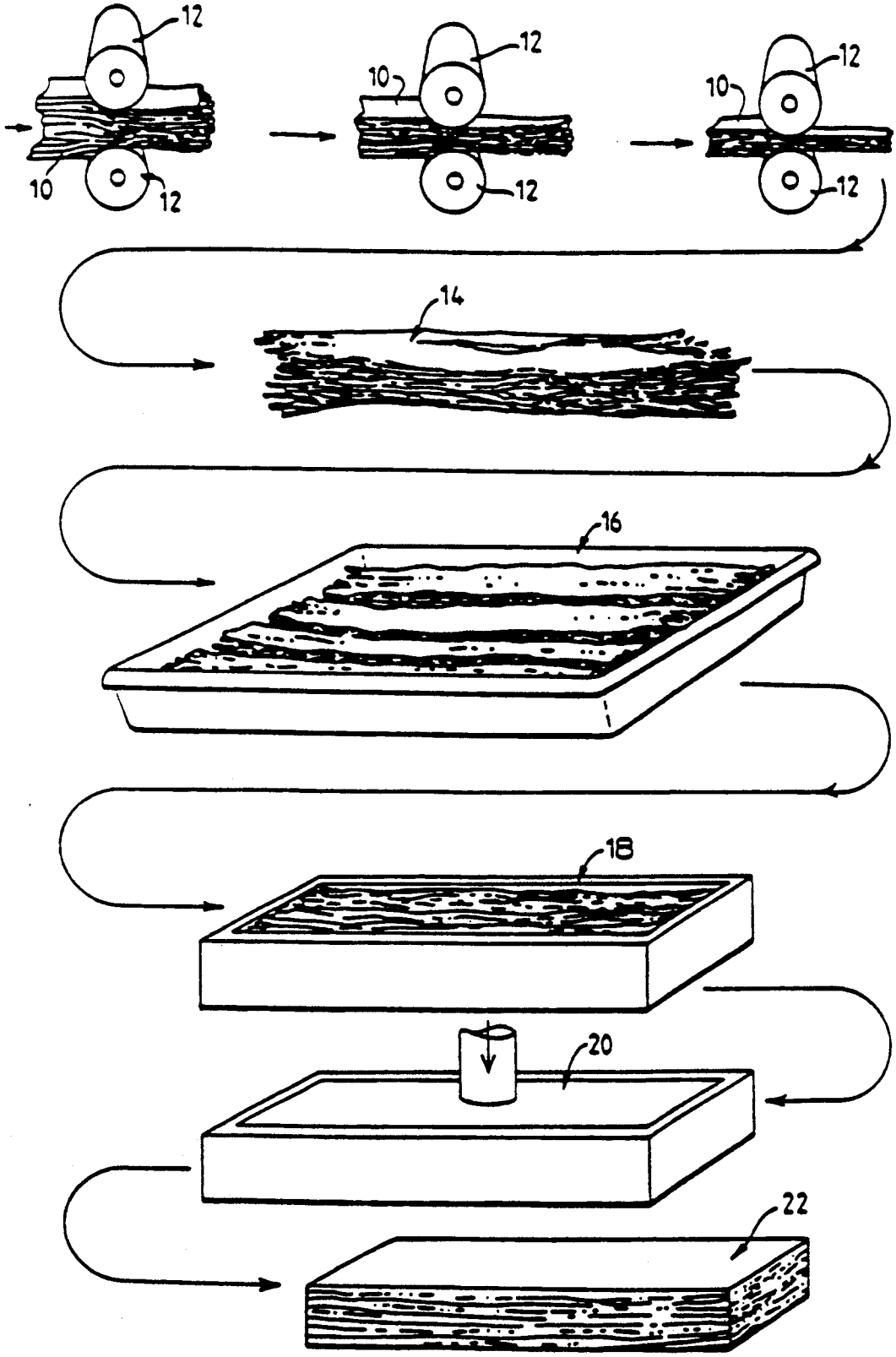
FIG. 1 is a diagram showing the steps in processing reconsolidated wood products in accordance with the invention described in the aforementioned Australian Patent No. 510,845.

Referring now firstly to FIG. 1, in the process of Australian Patent Specification 510,845 natural wood logs 10 are first partially broken down by being passed successively between rollers 12 of one or more plane roller pairs to induce cracking and thence progressively open up the log structure to form it into a web of loosely interconnected splinter-like strands (called "splinters" in Patent Specification 510,845).

The resultant web, shown at 14 in FIG. 1, is of flexible open lattice work form, individual strands generally maintaining the original grain direction of the wood. Adhesive is then applied to the webs 14 such as by immersion in a suitable liquid adhesive in a bath 16 as shown but preferably in accordance with our co-pending international patent application PCT/AU87/00437. After removal of excess adhesive, a plurality of webs 14 are assembled together in superposed manner, for example in a suitable mould 18, such that the individual webs in the assemblage are aligned in a common grain direction. The assemblage of thus aligned webs is then compressed in mould 18 such as by compression between the base of the mould and an upper press element 20 as shown, and the adhesive is cured while the webs are compressed to form the final product 22. The axis of the webs may be inclined relative to the longitudinal axis of the product and the consolidation of the webs by compressing and curing may be performed in a continuous, semi-continuous or batch manner.

The formation of the intermediate web 14 is of critical importance in practising the above described process; it is necessary to efficiently produce webs in a fashion such that they possess the required open lattice work structure. It has now been found that webs 14 having optimum properties can be produced more efficiently if during a refining and spreading process after crushing of the initial log, a relative reciprocatory movement is introduced as between the rollers of at least two roller pairs in which the rollers are corrugated and spaced with the maximum spacings between the corrugations of the opposed spaced corrugated rollers reducing in the roller pairs with increasing distance from the crushing rollers and if a pair of intermeshing corrugated rollers is provided between the at least two spaced corrugated roller pairs. The relative reciprocatory movement of the spaced corrugated roller pairs is introduced in the direction parallel to the axes of the two rollers and is conveniently achieved in accordance with Australian Patent Specification 36764/84 whose disclosure is included herein by reference.

Referring now generally to the process of forming webs of loosely interconnected strands, the purpose of the process is to reduce solid wood pieces (trunks, branches and waste mill sections) to webs having small-section interconnected and oriented strands which webs can then be readily dried (if necessary), coated with glue, superposed, moulded to a desired shape, and press cured to manufacture strong and useful products.

For this purpose it is most convenient to use small diameter straight round logs but the process is not restricted to any particular raw material log diameter or section shape, and satisfactorily reduced wood has been obtained from saw-milled sections and off cuts as well as twisted, knotty and branch material. The bottom diameter limit is established not by the wood properties but by the design of the raw material feed system and the economy related to the collection and preparation of the wood and the amount of material obtainable from these small pieces. For convenience only in the preferred process, the lower diameter limit has been set at 75 mm but end. At the top end of the range trees with diameter above 150 mm begin to be of value for saw milling and 200 mm probably represents the ultimate limit since timber above this size will be readily usable elsewhere.

A further restriction on the diameter range used in any specific operation is the volume of material variation which is proportional to the square of the diameter. Thus for the range 75 mm to 150 mm there is a 4:1 variation in the amount of material obtained from the largest and smallest logs. If the range is extended from 50 to 200 mm this volume variation becomes 16:1. Obviously machinery built to handle 200 mm diameter logs would be very underutilised if fed 50 mm logs and plant output would be drastically reduced. While this can be somewhat corrected by multiple feeding the smaller logs, the plant must be designed and built relative to the proposed raw material size range.

It is entirely feasible that trees as small as 25 mm diameter could be used provided that an adequate continuing resource was available with suitable harvesting and handling procedures.

The logs are preferably cut to a common length, debarked and sorted into convenient diameter groupings.

Logs of a common diameter range are first crushed by passing them in their axial direction through a series of rolling mill pairs with reducing gaps and preferably reducing diameters. The same result may be achieved by repeated passing through a single mill pair with the gap reduced and the pressure increased for successive passes. The crushing rollers generally have a smooth rolling surface.

In this crushing operation the log is longitudinally split into numerous fragments each ideally of length the same as the original log. These fragments are still held together by lateral connections so that the resulting carcase generally remains a single identity. Although flattened by the rolling process, the log carcase if allowed to rest will slowly revert to an oval or nearly round section but with a cross-sectional area considerably greater than that of the original log.

It is important that in crushing the log the incidence of transverse fractures within the fragments be minimised and to this end it has been found advantageous to crush gently for the first two passes and then increase the crushing force for subsequent passes. The effectiveness of the crushing is vital to the success of the following operations and it is desirable that the logs be overcrushed rather than undercrushed. It may be that the carcase will split longitudinally into two or more separate fragments during the crushing. This is not detrimental provided that the pieces are substantially full length and do not have severe changes or variation in section due to lateral fracture.

After crushing, the material is subjected to a series of spreading and refining operations to reduce the open log carcase to a flat web 14 of substantially uniform strand size and density. The strands within the web are still interconnected to a reasonable degree and are still oriented in the original grain direction. In the final web each strand should form a very small part but will comprises a multitude of fibres and generally will have a cross-sectional area in the range from about 1 to 10 $mm^2$ or thicker. Typically, the naturally interconnected wood fibre strands are hundreds or may even thousands of times longer than the individual wood fibres. In each strand the fibres and the original wood structure are preferably essentially undamaged.

One convenient means of obtaining the spreading action of the crushed carcase is described in Australian Patent Specification 36764/84. In this process the precrushed log is passed between a pair of rollers one of which reciprocates axially relative to the other. The surfaces of these rollers were discussed in general terms and a surface comprising a series of parallel circumferential grooves was described. While it has been found that rollers made to this design can be used to spread and refine the web, a more advantageous use of the system has been discovered where a series of at least two spaced corrugated roller pairs is available and this is shown in steps 1, 4 and 6 of FIGS. 2, 3*a* and 3*b* with three such roller pairs, in each of which one roller is axially reciprocable.

In each of the steps 1, 4 and 6 of the spreading and refining process, the roller mill pairs 30 are substantially identical and, for convenience, only one will be described. Each roller mill pair 30 comprises two substantially cylindrical rollers 32 as clearly shown in FIG. 2 (only partly shown in FIGS. 3*a* and 3*b*) which are vertically spaced for rotation about parallel horizontal axes. Also as shown in FIG. 2 the upper roller 32 in each roller pair 30 is axially reciprocable but since such reciprocation is fully described in the aforementioned Australian Patent Specification 36764/84 this feature will not be described further herein. The lower roller 32 in each roller pair 30 is axially fixed. One or both of the rollers 32 may be rotatably driven.

The peripheral surface 34 of each roller 32 is corrugated along its entire length with a series of annular troughs 36 extending about the peripheral surface coaxially with the axis of rotation 38 (see FIG. 2) of the roller. Adjacent troughs 36 are closely separated by a co-axial annular peak 40. Each trough 36 is of substantially semi-circular, cross-section, or slightly less than semi-circular, and the troughs in each roller pair 30 are the same depth. The peaks 40 in each roller 32 have narrow axially flat outer surfaces 42 which are aligned so that the peaks have a common height. The arcuate surface of the troughs 36 may extend to the outer surface 42 of the peaks, or the arcuate surface of the troughs may be set radially inwardly of the peaks in which case the peaks may have parallel side walls.

As illustrated the rollers 32 of all of the roller pairs 30 in steps 1, 4 and 6 are identical but are spaced to a decreasing extent from step 1 through step 4 to step 6. In an alternative embodiment the spacing of the peaks 40 between the opposed rollers 32 of each roller pair 30 may remain the same for all of the roller pairs 30 but the depth of the troughs, and optionally the axial length of each trough, may decrease from the rollers in step 1 through the rollers in step 4 to the rollers in step 6.

Because of the unity of the carcase 13 after crushing in the roller pairs 12 and the coarseness of the fragments, the material bulk presented to the spreading mill 30 in step 1 is relatively thick and narrow, and at this stage a relatively large spacing between the bottoms of the troughs of the rollers is needed to allow passage of the wood through the nip 44 of the rollers 32. Equal size troughs 36 on both rollers of each spaced corrugated roller pair 30 ensures that the refining action tends to work across the middle of the carcase. The refining action in the roll nip 44 during the relative reciprocation of the rollers is a combination of lateral tearing and some rolling of the wood in the troughs which refines the strand section.

On exit from the rollers 322 of step 1 the web body is more open and generally comprises smaller interconnected strands than before. The same process is followed at the second pair 30 of separating rollers 32 in step 4 in which the spacing between the opposed troughs 36 is smaller than in step 1 and which may have smaller section grooves. This process is repeated again at a third pair 30 of spaced corrugated separating rollers 32 in step 6 in which the opposed trough 36 are even closer together, and still further pairs 30 may be utilised until the required reduction of the wood is achieved.

It may be found, particularly with pinus radiata, that the coherence of the carcase continues through the reduction process, generally due to the presence of a spiral grain growth and to knot whorls, and this may only be overcome by breaking the carcase open. Australian Patent Specification 36762/84 describes the use of a vertical knife positioned immediately before a pair of pinch rollers to halve the log carcase during the reduction process. While this procedure has been used effectively to break the carcase continuity and open the material for more effective refining and spreading action, it also provided a means whereby larger logs than those for which the spreading and refining machinery was designed could be processed after crushing.

However, the use of the vertical knife may produce two significant defects. In the first place the action of the knife may tend to slice across the grain instead of splitting along the grain particularly in the case of logs with spiral grain. This will result in an increase in the percentage of short disconnected strands. The second defect is uneven halving of the crushed log carcase, whereby unless splitting of the log carcase is started and maintained with the knife at the centre, the carcase may veer uncontrollably to one side resulting in two pieces that are not equal in size and may be severely distorted lengthwise. The primary reason for this uncontrollability is the use of a downstream pinch roll to pull the carcase across the knife; as soon as one side piece is larger than the other more force is exerted on that side and more material is drawn to that side.

These defects can be reduced by ensuring that the logs are well crushed and knots, which are the main knife deflectors, are minimised. It two or three knives are used in parallel the uneven pull may be compounded.

We have now found that these difficulties can be overcome if the splitting knife is made part of the pinch roll assembly and rotated with it. This is shown in a roller pair 46 in step 2 downstream of step 1 in FIG. 2 and in greater detail in FIG. 3*a*. The blades 48 are relatively blunt so as to minimise any cutting action and in a preferred embodiment a gang of eight spaced blades 48 has been used successfully to break up the coherence of log carcases. However fewer or more may be used successfully and in FIG. 3*a* only five have been shown for convenience.

The annular blades 48 are ganged together in spaced apart manner on one roller 50 of the pinch roll assembly 46 in step 2 with the knives projecting beyond the roller surface 54. The opposed lower roller 56 in the pinch roll assembly 52 has a corrugated peripheral surface in which the annular grooves 58 have a frustoconical cross-section and are spaced apart by short lands 60 at the peaks. Each blade 48 in the upper roller 50 of the pinch roll assembly 46 is disposed opposite to a respective groove 58 in the lower roller. The rollers 50 and 56 may be set so that the outer edges of the blades 48 just clear the respective bottom surfaces of the grooves 58. By this means the web material below the blades 48 is stretched into the grooves 58 around the blades as it passes through the roll nip 62 and cutting or breaking of the strands is minimised. Most of the wood material at any one time is accommodated in the roll nip 62 in the spaces between the blades 48. The force exerted on the roller blades 48 by the material in the nip 62 may be reacted through air cylinders (not shown) which allow the nip to open if more material than normal is processed.

The passage of a carcase through the pinch roll assembly 46 of step 2 has been found effective in reducing its resistance to spreading and in reducing large knots to a degree more amenable to subsequent processing.

The process of the material through the blades 48 may be facilitated and improved if the carcase is flattened by passing it through a pair of plane rollers 64 immediately prior to the pinch roll assembly 52 in step 2, as shown in FIG. 2.

The principal role of the spaced corrugated rollers 32 in steps 1, 4 and 6 is to reduce the size of the interconnected strands of wood and to open out the carcase. However, in order to readily pass through the gradually reducing nips 44 of the roller pairs 30 in steps 1, 4 and 6 the carcase web must be spread laterally to reduce its thickness and this is performed by corrugated roller pairs 66 in which the teeth 68 intermesh, the roller pairs 66 being disposed between the adjacent space corrugated roller pairs 30 of steps 1 and 4 and of steps 4 and 6 respectively. The intermeshing roller pairs 66 are shown in steps 3 and 5 in FIG. 2 and in greater detail in FIGS. 3*a* and 3*b*. When the web passes through the intermeshing roller pairs 66 it is forced to spread into the longer path represented by the serpentine nip between the surface of the teeth 68. Clearly the height of the teeth 68 and the degree of intermeshing will control the degree of spread obtainable, remembering that complete separation of the strands in the web is to be avoided.

The rollers 70 of the roller pair 66 in step 3 are substantially identical but the annular teeth 68 of one roller 70 are offset with respect to the annular teeth 68 of the other roller so as to permit the intermeshing. The teeth are conical in cross-section with the inclined sides of adjacent teeth in one roller merging to define a corresponding annular V-shaped groove between the teeth. The teeth of the opposing rollers intermesh to about one third of their height to define a serpentine nip 72 of considerably greater effective length than a linear nip of identical width and axial length. The teeth 68 are provided along substantially the full length of the rollers 70. Increasing the depth of the nip 72 not only increases the permissible width of the web which can pass through but also reduces the effective length of the nip.

The rollers 74 of the roller pair 66 in step 5 are very similar to the rollers 70 and accordingly will only be described in so far as they differ from the roller 70. The teeth 68 of roller 74 are of similar cross-section to those of rollers 70 but are somewhat smaller and are spaced by axially extending lands 76 so that the annular grooves 78 between the teeth are of truncated triangular cross-section. The lands 76 permit the teeth of roller 74 to intermesh to about one third of their depth while maintaining a similar nip depth as the rollers 70 at the same penetration. Because of the smaller height of the teeth 68 in roller 74 the effective length of the serpentine nip 80 between rollers 74 is less than that of the nip 72, and this is to minimise complete separation of the strands of the web while still spreading the web.

The intermeshing rollers of the roller pairs 66 in steps 3 and 5 may also be useful in realigning strands that have become disoriented in the preceding processing.

In practice for pinus radiata logs up to 110 mm it has been found that optimum results are obtained when the sequence of spreading and refining mills after crushing is:

1. Reciprocating spaced corrugated rollers 32;
2. Plane flattening rollers 64 followed by parallel rolling blades 48;
3. Intermeshing spreading rollers 70 to increase web width 20–30%;
4. Reciprocating spaced corrugated rollers 32 with reduced spacing between opposed grooves;
5. Intermeshing spreading rollers 74 to increase web width 20–30%;
6. Reciprocating spaced corrugated rollers 32 with further reduced spacing between opposed grooves;
7. Rolling harrow 82 to finally adjust web alignment, or another pair of intermeshing rollers (not shown but similar to rollers 74).

It should be emphasised that the above sequence is illustrative only and the sequence of refining mills, knives and intermeshing spreading rollers may be varied as required to obtain optimum results.

The purpose of the rolling harrow 82 is to realign any short pieces that become offset in the last rolling stage and to prevent the osciallation of this last refining mill 30 in step 6 appearing as a waviness in the web. The rolling harrow 82 comprises an essentially cylindrical roller 84 (as suggested in step 7 in FIG. 2) supported over a surface 86 which comprises either a planar surface along which the web is displaced or a cooperating plane roller. The roller 84 has a series of spaced, parallel and radially extending circular plates 88 supported thereon for rotation with the roller. The plates 88 are essentially flat and have tapering peripheral edges 90. The peripheral edges 90 of the plates 88 are spaced from the surface 86 so as to permit the web 14 to be readily drawn through the nip on rotation of the harrow while at the same time realigning offset pieces of the web and generally smoothing the web. The spacing of the harrow 82 from the opposed surface 86 is adjustable to allow for different thicknesses of webs.

While the opposed sides of each plate 88 are shown to be parallel in FIG. 3*b*, and this is a practical embodiment, it may be advantageous for the thickness of the plates to taper slightly from adjacent the roller 84 to the peripheral edges 90. Thus each side surface of the plates 88 may be inclined up to approximately 5°, or possibly more, from the principal plane of the respective plate. Such an arrangement may alleviate any possibility of web material being picked up between adjacent plates 88 as the roller 84 rotates, and becoming caught.

It will be understood that the described process is given by way of example only and many modifications and variations will be apparent to those skilled in the art. All such modifications and variations should be considered as within the scope of the present invention as defined by the appended claims. In particular it will be appreciated that the reduction of the spacing of the opposed rollers of the successive spaced corrugated roller pairs could be achieved by maintaining the peaks of the opposed corrugations at a fixed or substantially fixed separation and reducing the dimensions of the grooves in which case the majority of the material is preferably accommodated in the grooves.

What is claimed is:

1. A process for partially rending natural wood to form a flexible open lattice work web of naturally interconnected wood strands which are generally aligned along a common grain direction, a substantial proportion of said strands being substantially discrete but incompletely separated from each other, said rending being effected by crushing the natural wood between a pair of rollers arranged with generally parallel axes by rolling engaging the natural wood from either side to form an open carcase of the natural wood and by spreading and refining the carcase to form the web, said spreading and refining comprising passing the crushed carcase through at least two roller pairs which have spaced corrugated rollers and in which the maximum spacing between the corrugations of the opposed spaced corrugated rollers decreases in the roller pairs with increasing distance along a spreading and refining path from the crushing rollers, reciprocating at least one roller of each spaced corrugated roller pair relative to the other roller of said pair during said pass, and passing the carcase through a pair of intermeshing corrugated rollers after said pass through a first of the pairs of spaced corrugated rollers and before said pass through a further of the pairs of spaced corrugated rollers.

2. A process according to claim 1 further comprising passing the carcase through a respective pair of intermeshing corrugated rollers between every two adjacent pairs of spaced corrugated rollers.

3. A process according to claim 1 further comprising determining the nip between the pair of intermeshing corrugated rollers according to the nip between the next adjacent downstream pair of spaced corrugated rollers.

4. A process according to claim 1 further comprising reducing the maximum spacing of the corrugations of the spaced corrugated roller pairs by providing rollers having corrugations of substantially the same size in all of the spaced corrugated roller pairs and reducing the distance between the troughs of the opposed rollers with increasing distance of the spaced corrugated roller pairs along the spreading and refining path.

5. A process according to claim 1 further comprising reducing the maximum spacing of the corrugations of the spaced corrugated roller pairs by providing rollers having corrugations of reducing size with increasing distance of the spaced corrugated roller pairs along the spreading and refining path.

6. A process according to claim 1 wherein after passing the crushed carcase through the last pair of spaced corrugated rollers in the spreading and refining process, passing the crushed carcase through a rolling harrow.

7. A process according to claim 1 wherein after passing the crushed carcase through the last pair of spaced corrugated rollers in the spreading and refining process, passing the crushed carcase through a further pair of intermeshing corrugated rollers.

8. A process for forming a reconsolidated wood product which comprises the steps of partially rending natural wood to form a plurality of flexible open lattice work webs each of naturally interconnected wood strands which are generally aligned along a common grain direction, a substantial proportion of said strands in each web being substantially discrete but incompletely separated from each other, superposing the webs, compressing the superposed webs to consolidate the strands whilst maintaining them such as to substantially extend in said original grain direction and bonding the strands of the webs together to hold them in juxtapositions assumed pursuant to said consolidation, and wherein said partially rending step is effected by crushing the natural wood between a pair of rollers arranged with generally parallel axes by rollingly engaging the natural wood from either side to form an open carcase of the natural wood and by spreading and refining the carcase to form the web, said spreading and refining comprising passing the crushed carcase through at least two roller pairs which have spaced corrugated rollers and in which the maximum spacing between the corrugations of the opposed spaced corrugated rollers decreases in the roller pairs with increasing distance along a spreading and refining path from the crushing rollers, reciprocating at least one roller of each spaced corrugated roller pair relative to the other roller of said pair during said pass, and passing the carcase through a pair of intermeshing corrugated rollers after said pass through a first of the pairs of spaced corrugated rollers and before said pass through a further of the pairs of spaced corrugated rollers.

9. Apparatus for rending natural wood to form natural wood into a flexible open lattice work web of substantially parallel aligned naturally interconnected strands, the apparatus comprising a pair of spaced generally parallel axially rotatable crushing rollers, at least two roller pairs downstream of the crushing roller pair each comprising a pair of spaced generally parallel axially rotatable corrugated rollers of which at least one is axially reciprocable relative to the other with the maximum spacing between the corrugations of the opposed spaced rollers decreasing in the roller pairs with increasing distance along a spreading and refining path from the crushing roller pair, and a pair of intermeshing corrugated rollers between said at least two spaced corrugated roller pairs.

10. Apparatus according to claim 9 wherein the trough of each corrugation of the spaced corrugated roller pairs is part-circular in cross-section.

11. Apparatus according to claim 10 wherein each said trough is substantially semi-circular in cross-section.

12. Apparatus according to claim 11 wherein the troughs in each roller of the spaced corrugated roller pairs are closely spaced to define a narrow peak between adjacent troughs.

13. Apparatus according to claim 9 wherein the corrugations of the spaced corrugated roller pairs are substantially identical along the length of each roller.

14. Apparatus according to claim 9 wherein said reduction in the maximum spacing of the corrugations of the spaced corrugated roller pairs is achieved by providing rollers having corrugations of substantially the same size in all of the spaced corrugated roller pairs and reducing the distance between the troughs of the opposed rollers with increasing distance of the spaced corrugated roller pairs along the spreading and refining path.

15. Apparatus according to claim 9 wherein said reduction in the maximum spacing of the corrugations of the spaced corrugated roller pairs is achieved by providing rollers having corrugations of reducing size with increasing distance of the spaced corrugated roller pairs along the spreading and refining path.

16. Apparatus according to claim 9 wherein more than two pairs of spaced corrugated rollers are provided and an intermeshing roller pair is provided between every two pairs.

17. Apparatus according to claim 9 wherein the cross-section of each peak of the rollers of the or each intermeshing roller pair is substantially conical.

18. Apparatus according to claim 9 wherein downstream of a last of the spaced corrugated roller pairs there is provided a rolling harrow which is rotatable over a support surface for the web and which comprises a series of axially spaced plates spaced above the support surface and whose peripheral edges are engagable with the web.

19. Apparatus according to claim 9 wherein downstream of a last of the spaced corrugated roller pairs there is provided a further pair of intermeshing corrugated rollers.

* * * * *